US008035470B2

(12) United States Patent
Viitanen et al.

(10) Patent No.: US 8,035,470 B2
(45) Date of Patent: Oct. 11, 2011

(54) PROTECTION OF PERMANENT MAGNETS IN A DC-INDUCTOR

(75) Inventors: Tero Viitanen, Vantaa (FI); Paulius Pieteris, Espoo (FI)

(73) Assignee: ABB Oy, Helsinki (FI)

( * ) Notice: Subject to any disclaimer, the term of this patent is extended or adjusted under 35 U.S.C. 154(b) by 78 days.

(21) Appl. No.: 12/122,818

(22) Filed: May 19, 2008

(65) Prior Publication Data

US 2008/0303619 A1 Dec. 11, 2008

(30) Foreign Application Priority Data

Jun. 8, 2007 (EP) ..... 07109849

(51) Int. Cl.
*H01F 21/00* (2006.01)
*H01F 17/06* (2006.01)
*H01F 27/24* (2006.01)

(52) U.S. Cl. ..... 336/110; 336/175; 336/212; 336/214

(58) Field of Classification Search ..... 336/110, 336/175, 212, 214

See application file for complete search history.

(56) References Cited

U.S. PATENT DOCUMENTS

| | | | | |
|---|---|---|---|---|
| 5,821,844 | A | 10/1998 | Tominaga et al. | |
| 6,812,818 | B2 * | 11/2004 | Lee | 336/55 |
| 7,471,178 | B2 * | 12/2008 | Koga | 336/90 |
| 2002/0033747 | A1 * | 3/2002 | Ito et al. | 336/178 |

FOREIGN PATENT DOCUMENTS

| | | |
|---|---|---|
| EP | 0 034 955 | 1/1981 |
| EP | 0 744 757 B1 | 11/1996 |
| FR | 2 839 580 | 11/2003 |
| GB | 694756 | 7/1953 |
| JP | 04-084405 | 3/1992 |
| JP | 2003-297649 | 10/2003 |
| JP | 2003-318046 | 11/2003 |

OTHER PUBLICATIONS

English translation of JP2003-318046.*
EPO Search Report and Extended Search Report.

* cited by examiner

*Primary Examiner* — Elvin G Enad
(74) *Attorney, Agent, or Firm* — Buchanan Ingersoll & Rooney PC

(57) ABSTRACT

A DC inductor comprising a core structure (11) comprising one or more magnetic gaps (12), a coil (14) inserted on the core structure (11), at least one permanent magnet (15) positioned in the core structure, the magnetization of the permanent magnet (15) opposing the magnetization producible by the coil (14). The core structure is adapted to form a main flux path and an auxiliary flux path, where the main flux path is adapted to carry the main magnetic flux producible by the coil, wherein the auxiliary flux path comprises a magnetic gap and is adapted to lead magnetic flux past the at least one permanent magnet (15).

10 Claims, 6 Drawing Sheets

PROTECTION OF PERMANENT MAGNETS IN A DC-INDUCTOR

FIELD OF THE INVENTION

The present invention relates to a DC inductor, and particularly to a DC inductor having at least one permanent magnet arranged in the core structure of the inductor.

BACKGROUND OF THE INVENTION

A major application of a DC inductor as a passive component is in a DC link of AC electrical drives. Inductors are used to reduce harmonics in the line currents in the input side rectifier system of an AC drive.

The use of permanent magnets in the DC inductors allows minimizing the cross-sectional area of the inductor core. The permanent magnets are arranged to the core structure in such a way that the magnetic flux or magnetization produced by the permanent magnets is opposite to that obtainable from the coil wound on the core structure. The opposing magnetization of coil and permanent magnets makes the resulting flux density smaller and enables thus smaller cross-sectional dimensions in the core to be used.

As is well known, permanent magnets have an ability to become demagnetized if an external magnetic field is applied to them. This external magnetic field has to be strong enough and applied opposite to the magnetization of the permanent magnet for permanent demagnetization. In the case of a DC inductor having a permanent magnet, demagnetization could occur if a considerably high current is led through the coil and/or if the structure of the core is not designed properly. The current that may cause demagnetization may be a result of a malfunction in the apparatus to which the DC inductor is connected.

Document EP 0 744 757 B1 discloses a DC reactor in which a permanent magnet is used and the above considerations are taken into account. The DC reactor in EP 0 744 757 B1 comprises a core structure to which the permanent magnets are attached. However, if very large currents flow through the coil winding during a fault, for example, the opposing magnetic field strength may be so large that permanent magnet is demagnetized permanently. Demagnetization of a permanent magnet in a DC inductor leads to a situation where the demagnetized piece has to be magnetized again. This means in practice that the DC inductor has to be removed from the apparatus and replaced with a new one.

One of the problems associated with the prior art structures relates thus to a permanent demagnetization of a permanent magnet in a DC inductor when excessive currents are flowing in the coil of the DC inductor.

BRIEF DESCRIPTION OF THE INVENTION

An object of the present invention is to provide a DC inductor so as to solve the above problem. The object of the invention is achieved by a DC inductor, which is characterized by what is stated in the independent claim. The preferred embodiments of the invention are disclosed in the dependent claims.

The invention is based on the idea of providing a core structure that includes a branch, which has a high magnetic reluctance due to a permanent magnet and dimensional arrangements of the branch and a magnetic gap, and which carries a magnetic flux caused by excessive currents. This branch includes a magnetic gap and it leads the magnetic flux past the permanent magnets before the flux starts to flow through them. The auxiliary branch thus modifies the magnetic path of the coil field such that the magnetic field intensity that would demagnetize the permanent magnet is limited to safer values.

An advantage of the DC inductor of the invention is that the auxiliary branch acts as a reverting fuse and protects the permanent magnets used in the DC inductor. Once a high current has flown in the coil of the inductor and the auxiliary branch has protected the permanent magnets, the operation of the DC-inductor reverts back to its normal operation. The auxiliary branch can also be used as a design parameter for obtaining a desired inductance to the DC inductor.

BRIEF DESCRIPTION OF THE DRAWINGS

In the following the invention will be described in greater detail by means of preferred embodiments with reference to the accompanying drawings, in which.

DETAILED DESCRIPTION OF THE INVENTION

Figure 1:
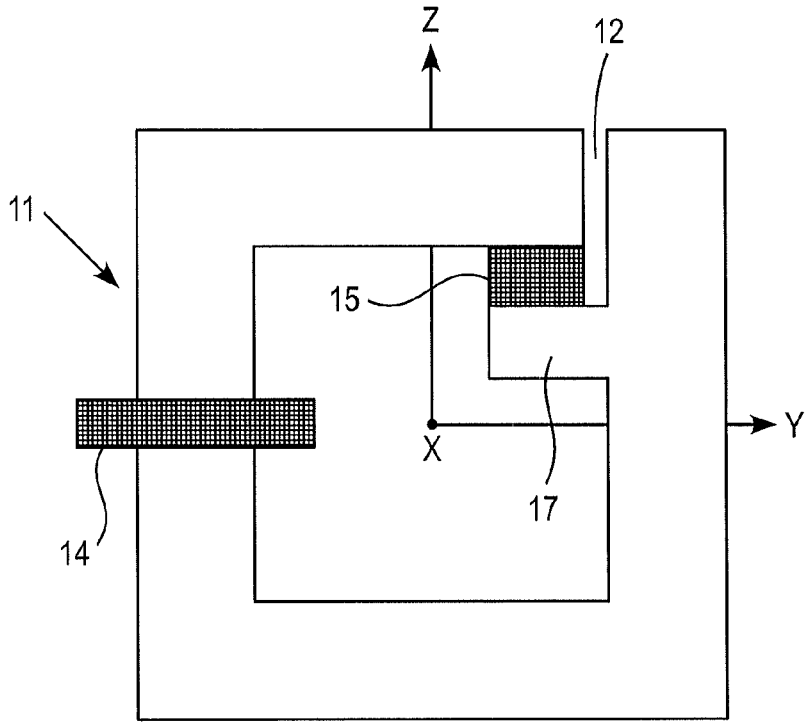
FIG. 1 shows a structure of a DC-inductor.

FIG. 1 shows a DC inductor that can be modified according to the present invention. The core structure 11 is formed of a magnetic material, i.e. material that is capable of leading a magnetic flux. The material can be for example laminated steel commonly used in inductors and as stator plates in motors, soft magnetic composite or iron powder.

Figure 2:
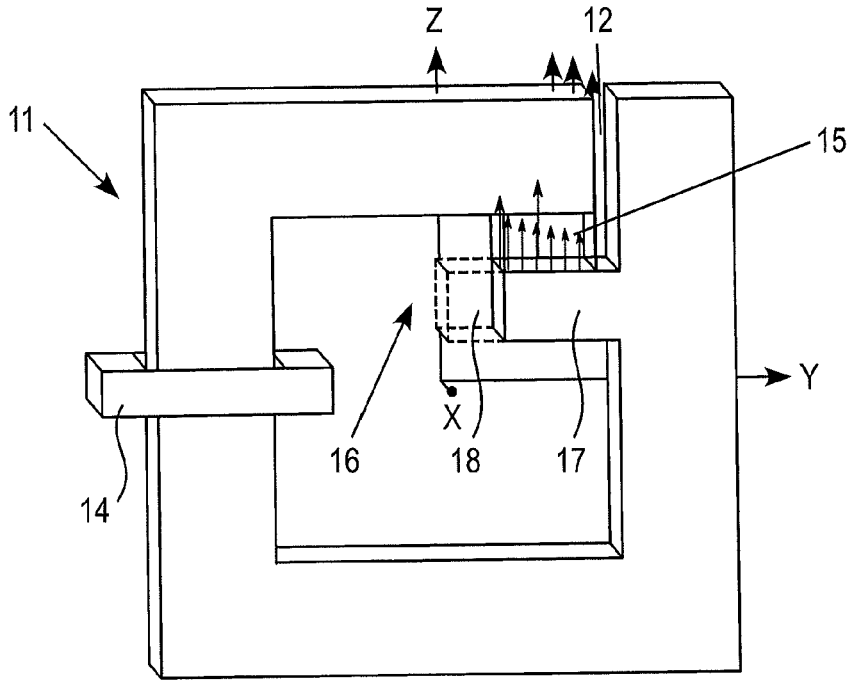
FIG. 2 shows the structure of the DC-inductor of FIG. 1 modified according to the invention.
Figure 6:
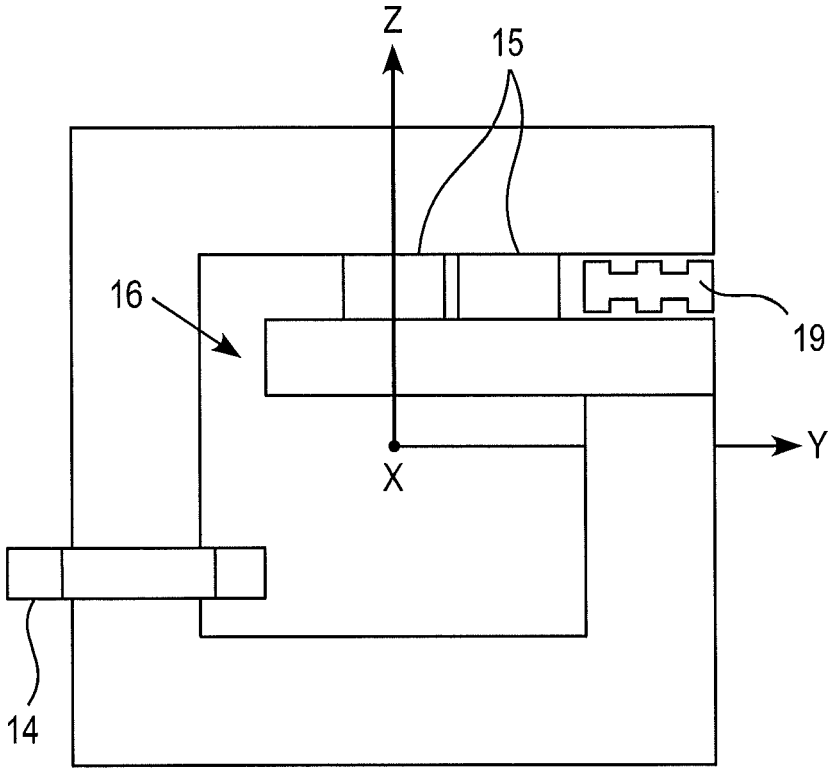
FIG. 6 shows a front view of another structure according to the invention.

FIG. 2 shows an embodiment of the DC inductor of the invention. The structure shown in FIG. 2 is based on the structure shown in FIG. 1. The DC inductor comprises at least one coil 14 inserted on the core structure and one or more magnetic gaps 12. The coil is typically wound on a bobbin and then inserted on the core structure in an ordinary manner. Alternatively, the coil may be wound directly onto the core without a bobbin. The gaps are formed in the main magnetic path, by which it is referred to the magnetic path the magnetic flux of the coil flows. In the core structure of the invention, magnetic gaps may be formed by using magnetic slabs 19 (FIG. 6). The material of the magnetic slab may include the same material as the core structure, but can also be of different materials. The material of the magnetic slabs may also be other magnetic material, such as ferrite materials or the like.

The magnetic slabs may be used to create magnetic gaps, i.e. air gaps, and the length and shape of the air gap so created may be varied by changing the dimensions and shape of the slab. Non-magnetic materials can also be used together with the magnetic slab(s) to support the slab(s) and to form the magnetic gap(s) to the core structure. Non-magnetic materials include plastic materials that have a similar effect in the magnetic path as an air gap. The magnetic gaps in a core structure are situated such that the gaps direct or block magnetic flux in order to aid to suppress the demagnetization effect upon the permanent magnets. In addition, different magnetic gap dimensions affect differently the total inductance of the DC inductor. However, a larger air gap decreases the numerical value of the inductance of the inductor but at the same time makes the inductance more linear, while a smaller magnetic gap has an opposite effect.

FIG. 2 also shows an auxiliary magnetic path in the form of a supporting member 17 made of magnetic material. The supporting member extends from the core structure inside the winding window of the core structure 11. The supporting member, which is basically an extended magnetic slab, holds or supports the at least one permanent magnet 15 in such a way that the supporting member forms a magnetic path for the magnetic flux of the permanent magnet. The supporting member may further be varied to vary the inductance of the DC inductor. The auxiliary magnetic path is shown in FIG. 2 as lighter shaded extension 18 to the supporting member 17 to indicate the possibility for variations in design. Thus the auxiliary magnetic path can be made longer or shorter, according on the need.

The auxiliary magnetic path closes via magnetic gap between the end of the supporting member 17 and a part of the core structure. According to an embodiment of the invention the reluctance defined by the magnetic gaps in the main flux path is smaller than the reluctance defined by the magnetic gap in the auxiliary flux path. The main flux path is the path in the core structure where the main part of the flux produced by the coil flows. In the case of FIG. 2, the main flux path is the outermost part of the core structure, i.e. the flux produced by the coil does not flow through the permanent magnet but through the air gap 12. The auxiliary flux path in the embodiment of FIG. 2 is formed of the supporting member and magnetic gap 16. Thus the reluctance of magnetic gap 16 is higher than the one of magnetic gap 12.

Further the reluctance defined by the magnetic gap in the auxiliary flux path is smaller than the effective reluctance defined by the permanent magnets. When the magnitudes of the reluctances are as above, the flux generated by the coil flows mainly in the main flux path (i.e. through the magnetic gap 12). A part of the flux generated by the coil flows through the auxiliary flux path all the time. The ratio of the fluxes flowing through different paths is defined by the ratio of the reluctances.

The purpose of the supporting member is to support the permanent magnet 15 and simultaneously to provide a path for the magnetic flux of the permanent magnet. As the supporting member is extended towards the core structure as shown in FIG. 2, it also provides the auxiliary flux path of the invention. The flux generated by the coil encounters the permanent magnet as a higher reluctance path and thus passes by the permanent magnet via the magnetic gap 12. On the other hand, the magnetic flux of the permanent magnet does not flow through the magnetic gap due to the reluctance encountered in air gaps, but through the coil 14 via the core structure and the supporting member.

Since the supporting member is an element made of magnetic material, it may also be considered as a magnetic slab. A magnetic gap may also be provided between the supporting member 17 and a part of the core structure next to the supporting member 17. If so desired, the magnetic gap may be formed by a thin non-magnetic material piece inserted therebetween.

In FIG. 2, the DC inductor is shown with only one permanent magnet 15. The structure, however, enables adjusting the main core structure simply by extending the supporting member parallel to the core structure and by adding more permanent magnets. FIG. 6 shows this possibility, where the supporting member is extended to hold two permanent magnets 15. The structure of FIG. 6 differs from the structure shown in FIG. 2 also with respect to the position of the magnetic gap. In FIG. 2 magnetic gap 12 is formed as an air gap whereas in FIG. 6 a magnetic slab 19 is used. FIG. 2 shows also the demagnetizing field upon the permanent magnet.

Figure 10:
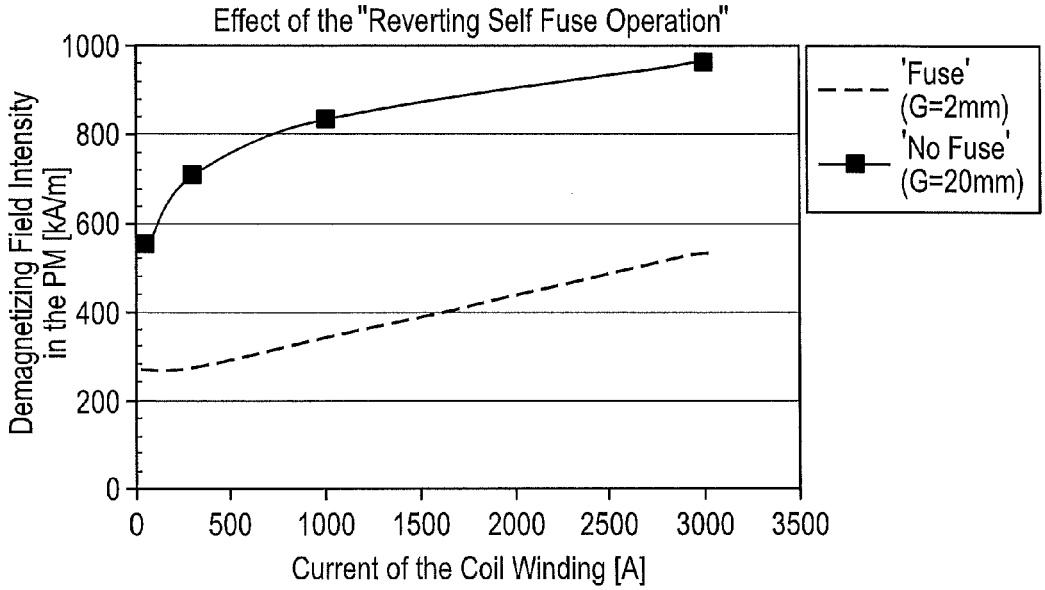
FIG. 10 shows an example of the effect of the invention in reducing the permanent magnet demagnetizing field intensity.

FIG. 10 shows the effect of the integrated reverting fuse on permanent magnet demagnetization field intensity for the core structure of FIG. 2. The dashed line shows the demagnetization field strength as a function of coil current in a structure according to the invention and with an auxiliary flux path present, i.e. when the supporting member is extended. The solid line shows the situation when an auxiliary flux path is not provided. It can be seen from FIG. 10 that the field intensity demagnetizing the permanent magnet is greatly reduced when measures according to the present invention are taken into use. Variable G in FIGS. 10 and 11 represents the length of the magnetic gap in the auxiliary magnetic path in the two examples presented in the figures.

Figure 11:
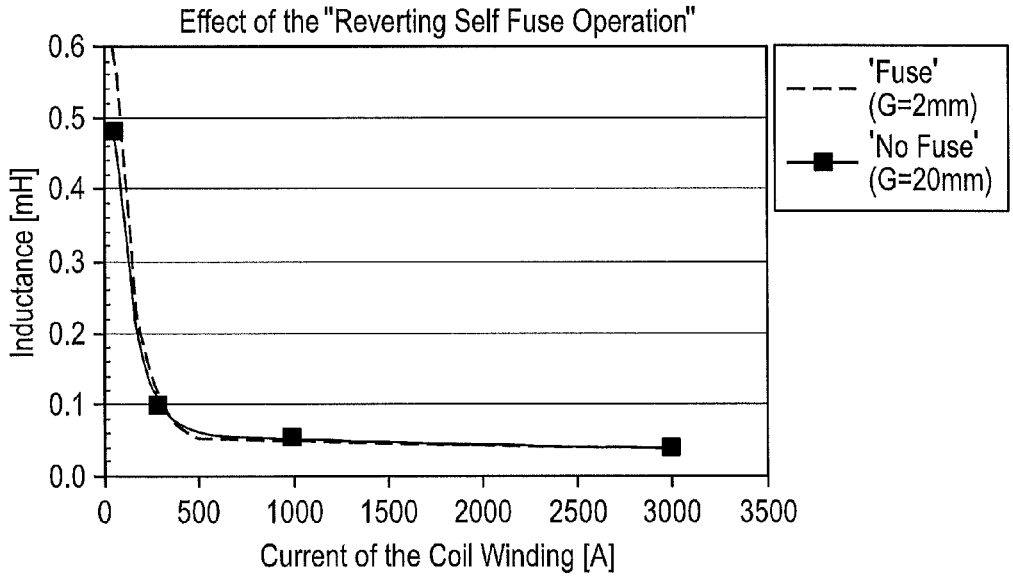
FIG. 11 shows an example of inductance curves as a function of coil current.

FIG. 11 indicates the inductances as a function of coil current. The dashed line shows the inductance of the structure of FIG. 2 with the auxiliary flux path and the solid line without the auxiliary flux path. At lower current levels (nominal operation) the fuse of the invention increases the inductance due to extra magnetic material in the magnetic circuit.

According to one embodiment of the invention the core structure comprises a fault detection device arranged to sense a faulty operation of the circuitry. The fault detection device may comprise one or more sensors detecting the magnitude of the magnetic flux. Such a sensor or device is preferably situated in a magnetic gap formed either to the auxiliary flux path or the main flux path. Each inductor is designed for a certain operational area in which the inductor operates as desired. Thus in each part of the core the magnetic flux has upper limits that should not be exceeded during normal operation. By using a flux sensor sensing the flux density a malfunction can be detected. When a malfunction is detected an alarm may be given and, further, the power supply to the system may be switched off for the protection of the other parts of the system in which the DC inductor is included.

The fault detection device may also be a current sensor sensing or measuring the current of the coil of the DC inductor. As mentioned above, inductors are designed to operate within a certain area. Magnetic flux in the inductor core is defined by the amount of current in the coil. Thus the highest allowable flux defines the highest allowable current. While the invention protects the permanent magnets from overcurrents, this malfunction should still be detected to provide protection against erroneous operations of the complete system. By providing the DC inductor of the invention with the fault detection device, one obtains a protective system which protects against both the demagnetization of the permanent magnets and other possible defects occurring due to overcurrents. As above, the current sensor produces an alarm according to which the system may be shut down. It is also possible merely to provide measurement information from the fault detection device which is further led to a control system, where the limits of currents or fluxes are set and which further provides the mentioned alarm.

The core structure of the invention may also comprise a temperature detecting sensor or similar means, which can be used for providing a signal representing the temperature. The temperature information is interesting in connection with the structure of the invention in that the demagnetization of permanent magnets depends on the temperature. The higher the temperature is the easier the permanent magnets demagnetize. The temperature or temperature difference between the parts of the core structure may thus also be used as an indication of malfunction.

The permanent magnets in FIG. 6 are arranged in a parallel relationship with each other. Further, the magnetic gaps in FIG. 6 are formed to be non-uniform. The non-uniformity is achieved by modifying the magnetic slab 19 in a desired manner. As a result of the non-uniformity of the magnetic gaps, a varying inductance curve is achieved. FIG. 6 also shows that the supporting member is extended according to the present invention to provide the auxiliary flux path through the magnetic gap 16.

Since the permanent magnets are somewhat fragile and brittle quite easily from mechanical impacts, it is very advantageous to position them inside the core structure. It can be seen from FIGS. 1 to 9 that the core structure covers four permanent magnet surfaces out of six so that the risk of mechanical impact is greatly reduced.

The permanent magnets are also fastened firmly to the core structure, since they are held in place from two opposing directions, i.e. above and below. The permanent magnets can be further glued or otherwise mechanically attached to the surrounding structure.

As seen from FIG. 6, the permanent magnets 15 are of substantially the same height as the magnetic slab 19 and the magnetic gaps 12. This allows the supporting member to be aligned parallel to the core structure.

Figure 7:
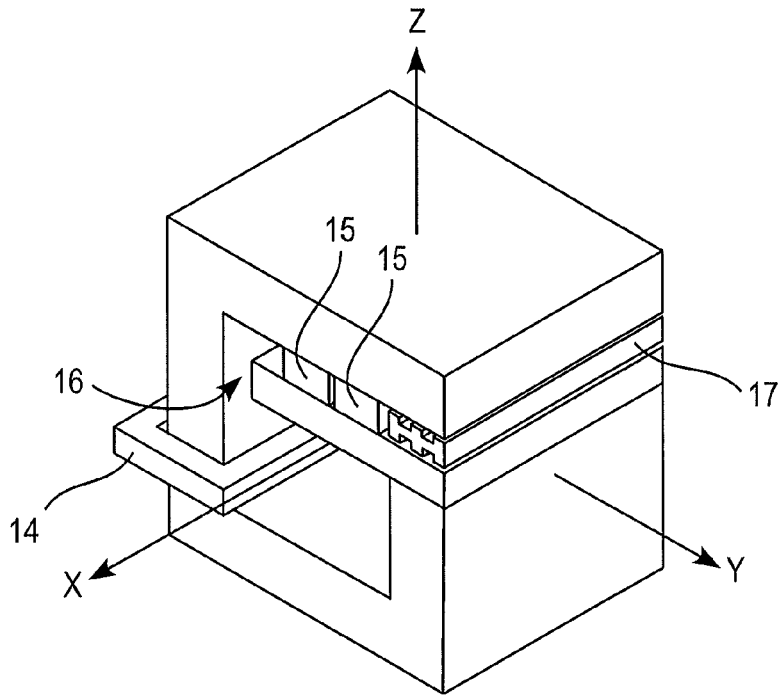
FIG. 7 shows a perspective view of the structure of FIG. 6.

FIG. 7 shows the embodiment of FIG. 6 in a perspective view.

Figure 3:
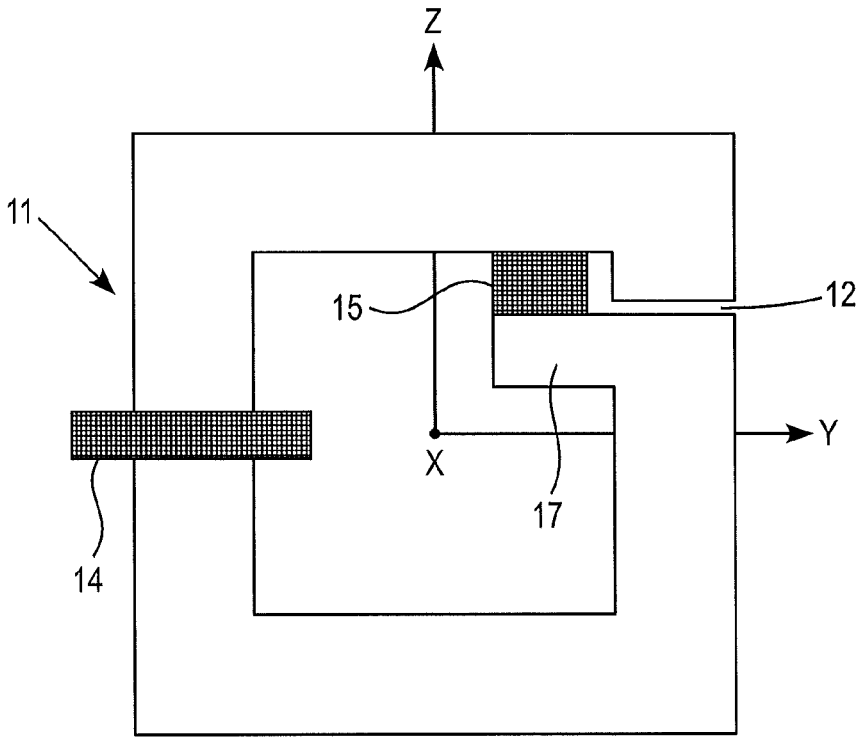
FIG. 3 shows another structure of a DC-inductor.

FIG. 3 shows an example of another core structure according to the invention. In this structure the air gap 12 is positioned differently than in FIG. 1. FIG. 3 does not show the extended supporting member, but it is clear that the auxiliary magnetic path may be formed similarly as in the structure of FIG. 1.

Figure 8:
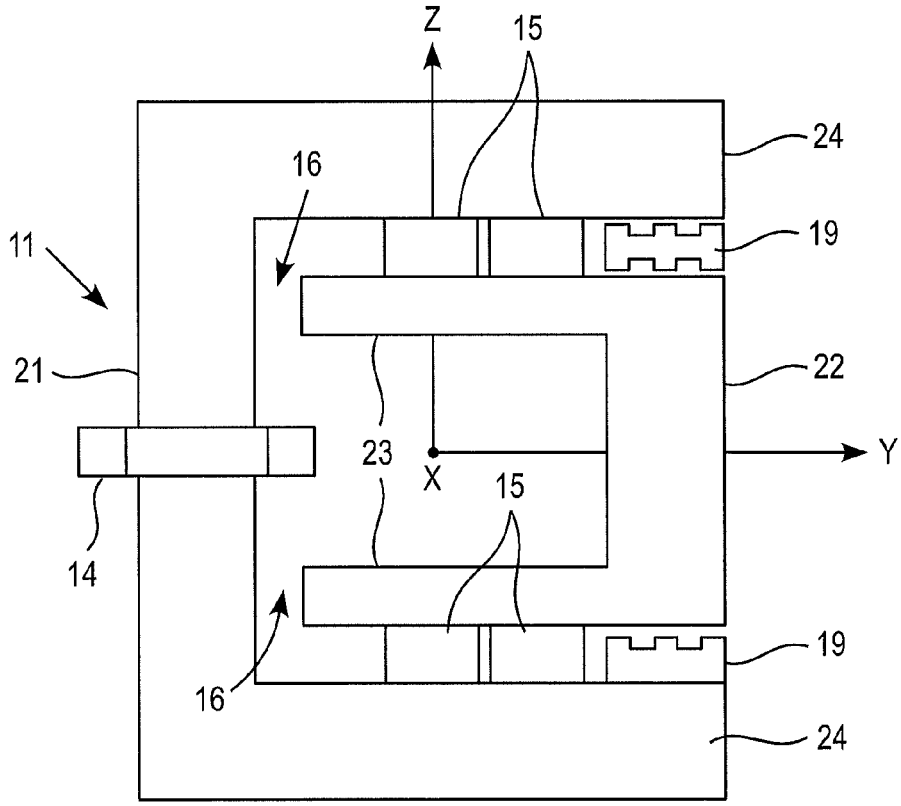
FIG. 8 shows another structure according to the invention.

FIG. 8 shows another embodiment of the present invention. In this embodiment, two supporting members are included in the inductor. The supporting members 23 extend parallel to the core structure and inside of it. In this embodiment, the core structure and the supporting members are formed of two U-shaped cores 21, 22. The first U-shaped core 21 forms the outer structure and the second U-shaped core 22, which is smaller than the first one, forms the supporting members 23 and one side of the main core structure. The second U-shaped core 22 is thus inserted between the legs of the first U-shaped core 21.

The supporting members are extended towards the core structure inside the core structure for providing the auxiliary flux paths. These auxiliary flux paths carry a part of the flux generated by the coil 14 and are defined by the supporting members 23 and air gaps 16. Again in this structure the flux of the coil is divided between the main flux path and the auxiliary flux path. Even if the current of the coil is higher than rated, the permanent magnets are not demagnetized, since the reluctance of the auxiliary flux path is smaller than that of the path through the permanent magnets. Thus the auxiliary flux path prevents the demagnetization of the permanent magnets that would otherwise occur.

FIG. 8 shows four permanent magnets 15, two of them situated between both supporting members 23 and the core structure. The permanent magnets are thus supported by the supporting members and are held between the outer surface of the legs of the second core structure and the inner surface of the legs of the first core structure.

The magnetic slabs 19 are inserted in a parallel fashion to the permanent magnets 15. The magnetic slabs are arranged in the main magnetic path, which means that slabs 19 are between the ends of the legs of the first U-shaped core and the base of the second U-shaped core. It is shown in FIG. 8 that the dimensions of the legs and base of the second U-shaped core are different. The base of the second U-shaped core carries the magnetic flux producible by the coil, similarly as the first U-shaped core, and to avoid uneven flux densities the cross sectional areas should be equal. Thus the base of the second U-shaped core has a cross-sectional area equal to that of the first U-shaped core. The supporting members, i.e. the legs of the second U-shaped core, carry mainly the flux produced by the permanent magnets, and the dimensions can be made smaller. It is, however, clear that the dimensioning of the cross-sectional areas can be carried out depending on the required use. Also the number of permanent magnets, slabs and magnetic gaps as well as their shapes depend on the application.

The structure of FIG. 8 is very advantageous since only basic magnetic core forms are used. The permanent magnets are again secured to the core structures and are kept away from most of mechanical impacts inside the structure. The magnetic slabs that are used to form the magnetic gaps are as described above. In the example of FIG. 8, the magnetic slabs are used to create three magnetic gaps, which are non-linear. With the slabs 19 shown in FIG. 8 up to four magnetic gaps can easily be made to the core structure. Any number of gaps can further be made non-uniform to obtain swinging inductance characteristics. Also the manufacturing process of the embodiment shown in FIG. 8 is simple. The first U-shaped core 21 can be directly mounted on a spindle machine and no separate bobbin for the coil is needed, if extra-insulated wire is used for the coil.

Figure 9:
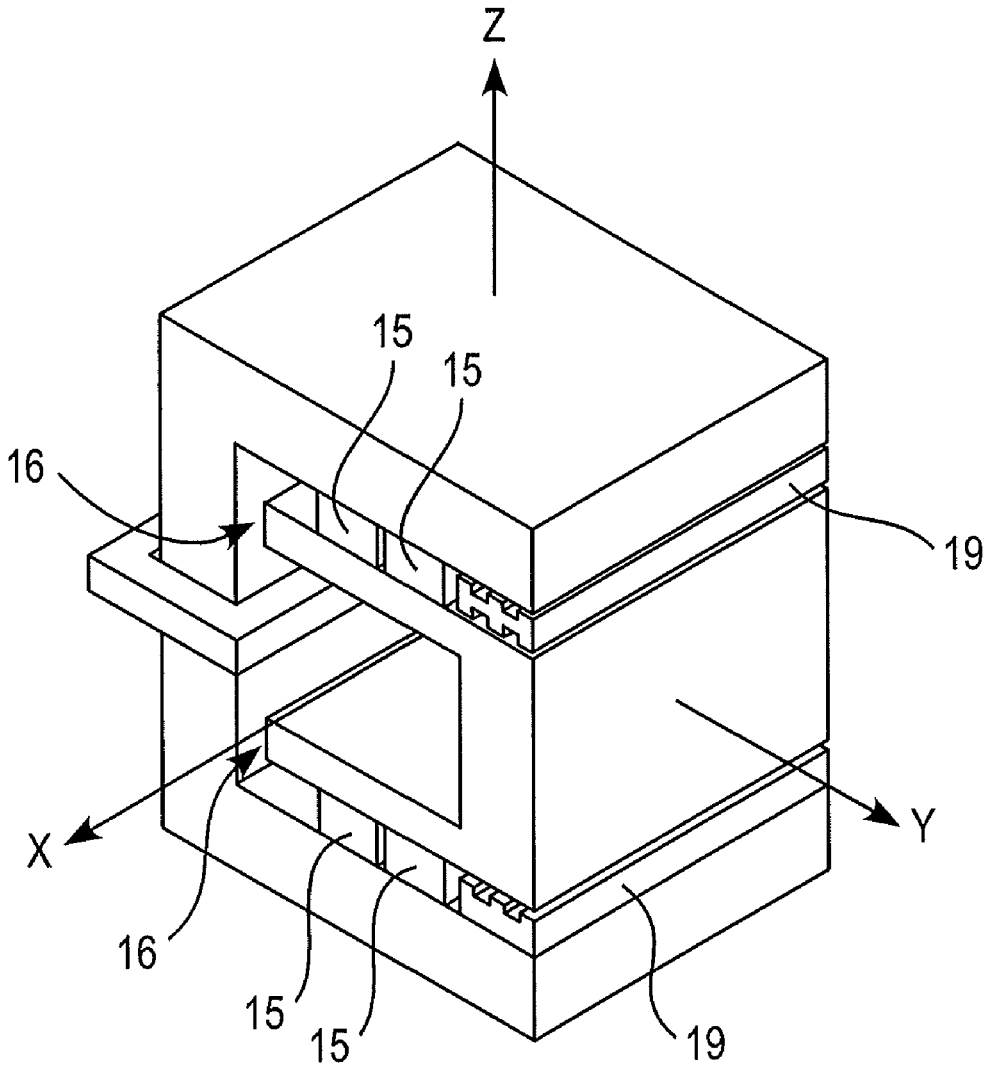
FIG. 9 shows a perspective view of the structure of FIG. 8.

FIG. 9 shows the structure of FIG. 8 in a perspective view.

Figure 4:
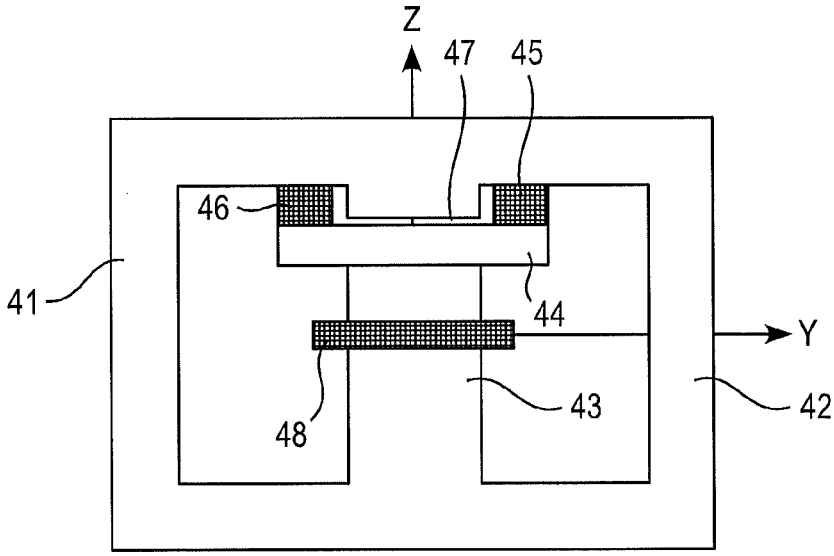
FIG. 4 shows yet another structure of a DC-inductor.
Figure 5:
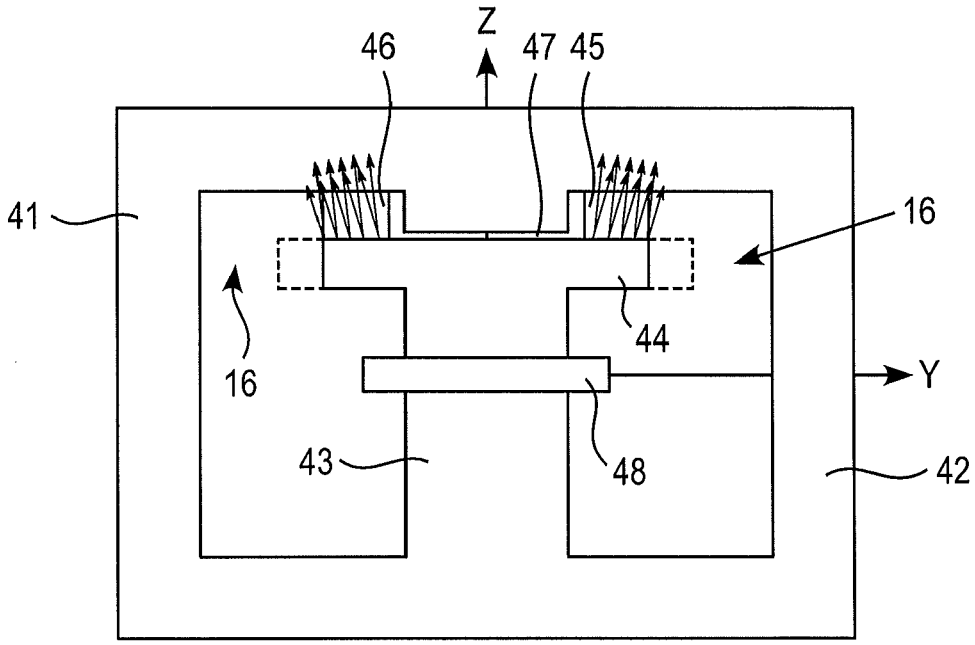
FIG. 5 shows the structure of FIG. 4 modified according to the invention.

FIGS. 4 and 5 show another structure of the DC inductor according to the present invention. In this structure the core structure comprises three legs 41, 42 and 43 and is basically a T-W core. The T-part of the core is situated on top of the W-core, with the supporting member arranged on the center leg 43. Supporting member 44, which extends in a parallel relationship with the core structure, further holds the permanent magnets 45, 46. The permanent magnets are between the supporting member and the core structure, especially the underside of the T-core. In this structure the magnetic gap 47 is formed to the center leg 43 above the supporting member. Another magnetic gap could also be provided in the joint between the center leg 43 of the W-core and the supporting member 44.

In FIGS. 4 and 5, the T-core presses against the permanent magnets 45, 46, which further press against the supporting member, which is attached to the center leg of the W-core. The main flux path is through the magnetic gap 47, while the flux of the permanent magnets use the supporting member. The supporting member 44 also forms the auxiliary flux path of the invention shown in FIG. 5. In FIG. 5 the supporting member is extended at both ends to provide the reverting fuse of the invention. The extended ends of the supporting member are shown as lighter extensions to the supporting member. The extended supporting member defines magnetic gaps 16 to the auxiliary flux path between the ends of the supporting member and the core structure. As with FIG. 2, the demagnetizing magnetic field acting on the permanent magnets 15 is shown.

In FIG. 5, the permanent magnets are situated so that there is a lateral air gap between them and the center leg of the core. This is to avoid leakage flux crossing the permanent magnet.

As with the previous structures, the supporting member may hold multiple permanent magnets. It is also shown in FIG. 5 that the coil 48 is wound on the center leg 43 of the core structure below the supporting member. This embodiment of the invention is advantageous in that the physical dimensions are kept small while still having multiple permanent magnets inside the core structure and having the auxiliary flux path of the invention.

In all of the above structures and their possible and described modifications, the supporting members may be used to hold more permanent magnets than shown or described. The number of permanent magnets has no effect on the auxiliary flux path and the number of the permanent magnets is not limited. Further, the magnetic slabs in any of the structures or their modifications are modifiable. The slabs may be modified to have more or fewer magnetic gaps and they may be either uniform or non-uniform, depending on the intended purpose of the DC inductor. Magnetic gaps may also be provided in any joint between the supporting member and the core structure, the supporting member may thus also be considered as being a magnetic slab. Often it is more desirable to have multiple shorter magnetic gaps than one larger magnetic gap, although the reluctance is defined by the total length of the magnetic gaps. This is due to the undesirable fringing effect of the magnetic flux, if magnetic gaps are too long.

In the above description, some shapes of magnetic material are referred to with letter shaped forms. It should be understood that a reference to a letter shape (such as "U") is made only for clarity, and the shape is not strictly limited to the shape of the letter in question. Further, while reference is made to a letter shape, these shapes may also be formed of multiple parts, thus the shapes need not to be an integral structure.

The above description uses relative terms in connection with the parts of the core structure. These referrals are made in view of the drawings. Thus for example upper parts refer to upper parts as seen in the corresponding figure. Consequently, these relative terms should not be considered limiting.

The term 'coil' as used in the document comprises the total coil winding wound around the core structure. The total coil winding may be made of a single wound winding wire or it can be made of two or more separate winding wires that are connected in series. The total coil winding can be wound onto one or more locations on the core structure. The total coil winding is characterized by the fact that the substantially same current flows through every wounded winding turn when current is applied to the coil.

It will be obvious to a person skilled in the art that, as the technology advances, the inventive concept can be implemented in various ways. The invention and its embodiments are not limited to the examples described above but may vary within the scope of the claims.

The invention claimed is:

1. A DC inductor comprising: a core structure comprising a plurality of magnetic gaps; a coil arranged on the core structure; and at least one permanent magnet positioned in the core structure, the magnetization of the at least one permanent magnet opposing the magnetization producible by the coil, wherein the core structure forms a main flux path and an auxiliary flux path, wherein the main flux path comprises a first magnetic gap among the plurality of magnetic gaps, the first magnetic gap carrying the main magnetic flux producible by the coil, and wherein the auxiliary flux path comprises a second magnetic gap among the plurality of magnetic gaps, the auxiliary flux path leading magnetic flux past the at least one permanent magnet and protecting the at least one permanent magnet from complete demagnetization; wherein the auxiliary flux path is comprised of a supporting member constituted by magnetic material, wherein the core structure comprises a winding window, and wherein the supporting member extends from the core structure inside the winding window of the core structure and holds the at least one permanent magnet.

2. The DC inductor according to claim 1, wherein the reluctance defined by the first magnetic gap in the main flux path is smaller than the reluctance defined by the second magnetic gap in the auxiliary flux path.

3. The DC inductor according to claim 2, wherein the reluctance defined by the second magnetic gap in the auxiliary flux path is smaller than the effective reluctance defined by the at least one permanent magnet.

4. The DC inductor according to claim 1, wherein the supporting member extends inside the winding window of the core structure towards a part of the core structure, and wherein the supporting member has a free end which defines, together with the part of the core structure, the second magnetic gap in the auxiliary flux path.

5. The DC inductor according to claim 2, wherein the auxiliary flux path is comprised of a supporting member constituted by magnetic material, wherein the supporting member is arranged to extend parallel to the core structure, and wherein the at least one permanent magnet is arranged between the supporting member and the core structure such that the supporting member, together with the core structure, forms a low reluctance magnetic path for the at least one permanent magnet.

6. The DC inductor according to claim 1, comprising at least one magnetic slab configured to define the first magnetic gap in the main flux path.

7. The DC inductor according to claim 2, wherein the auxiliary flux path is comprised of a supporting member constituted by magnetic material, wherein the core structure comprises an upper leg, wherein the supporting member extends parallel to the upper leg inside the core structure, and wherein the distance between the upper leg and the supporting member corresponds to a dimension of the at least one permanent magnet.

8. The DC inductor according to claim 1, comprising a fault detection device configured to sense at least one of a current of the coil and a flux of the core structure.

9. The DC inductor according to claim 8, wherein the fault detection device is configured to sense the flux of the core structure and is arranged in at least one of the first magnetic gap in the main flux path and the second magnetic gap in the auxiliary flux path.

10. The DC inductor according to claim 1, comprising a temperature detection device configured to sense the temperature of the core structure.

* * * * *